US009165461B1

(12) United States Patent
Chu

(10) Patent No.: US 9,165,461 B1
(45) Date of Patent: Oct. 20, 2015

(54) IMAGE PROCESSING BASED TRAFFIC FLOW CONTROL SYSTEM AND METHOD

(71) Applicant: Kevin Hwading Chu, Houston, TX (US)

(72) Inventor: Kevin Hwading Chu, Houston, TX (US)

(73) Assignee: Intellectual Fortress, LLC, Houston, TX (US)

( * ) Notice: Subject to any disclaimer, the term of this patent is extended or adjusted under 35 U.S.C. 154(b) by 0 days.

(21) Appl. No.: 14/705,728

(22) Filed: May 6, 2015

(51) Int. Cl.
*G08G 1/01* (2006.01)

(52) U.S. Cl.
CPC ..... *G08G 1/0145* (2013.01)

(58) Field of Classification Search
CPC ..... B60R 25/04; G08G 1/01; G08G 1/087; G08G 1/0145; G08G 1/164; G08G 1/0175; G07B 15/063; G01G 19/022; B60W 30/025
USPC ..... 701/117, 96; 340/907, 928, 989; 702/175, 182; 382/104
See application file for complete search history.

(56) References Cited

U.S. PATENT DOCUMENTS

| | | | | |
|---|---|---|---|---|
| 6,195,019 | B1 * | 2/2001 | Nagura | 340/928 |
| 6,737,989 | B2 * | 5/2004 | Flick | 340/989 |
| 2002/0082806 | A1 * | 6/2002 | Kaub | 702/182 |
| 2006/0095195 | A1 * | 5/2006 | Nishimura et al. | 701/96 |
| 2007/0069920 | A1 * | 3/2007 | Hakki et al. | 340/907 |
| 2009/0256721 | A1 * | 10/2009 | Glatfelter | 340/907 |
| 2013/0287261 | A1 * | 10/2013 | Lee et al. | 382/104 |
| 2014/0309966 | A1 * | 10/2014 | Cornu et al. | 702/175 |

FOREIGN PATENT DOCUMENTS

CA 2302998 A1 * 9/2001

* cited by examiner

*Primary Examiner* — Tuan C. To
*Assistant Examiner* — Yuri Kan

(57) ABSTRACT

A traffic flow control system that includes a display device, an image acquisition module, an user interactive device, and a server having a processor. The processor is configured to obtain, by a data aggregation module, at least one of a first, second, third, fourth set of data, compute, by a computation module, a travel score for a travel direction of an intersection by weighing each of the first, second, third, and the fourth set of data with respect to one another, determine whether the travel score is a highest travel score of the intersection, and, if the travel score is the highest travel score of the intersection, enable traffic flow in the travel direction using the display device.

20 Claims, 6 Drawing Sheets

IMAGE PROCESSING BASED TRAFFIC FLOW CONTROL SYSTEM AND METHOD

BACKGROUND

Commuters in big cities in the United States, e.g., Washington, District of Columbia, Los Angeles, San Francisco, New York City, Boston, Houston, Atlanta, Chicago, Philadelphia, Seattle, Miami, Dallas, Detroit, San Diego, Phoenix, etc., spend an average of 50 hours a year waiting in traffic. In one study, the cost of all this wasted time and fuel is estimated to be more than $100 billion a year. In other big cities around the world, e.g., Beijing, Shanghai, Tokyo, Brussels, Antwerp, Milan, London, Paris, Rotterdam, etc., the average can be much higher. A context-based traffic flow control system and method thereof can advantageously help minimize travel time and decrease traffic congestion.

SUMMARY

In general, in one aspect, one or more embodiments disclosed herein relate to a traffic flow control system comprising: a display device; an image acquisition module; an user interactive device; and a server having a processor, the processor is configured to: obtain, by a data aggregation module, at least one of a first set of data from a first type computing device, a second set of data from a second type computing device, a third set of data from the image acquisition module, a fourth set of data from the user interactive device, and a combination thereof, compute, by a computation module, a travel score for a travel direction of an intersection by weighing each of the first set of data, the second set of data, the third set of data, and the fourth set of data with respect to one another, determine whether the travel score is a highest travel score of the intersection, and, if the travel score is the highest travel score of the intersection, enable traffic flow in the travel direction using the display device.

In another aspect, one or more embodiments disclosed herein relate to a traffic flow control method comprising: (a) obtaining at least one of a first set of data, a second set of data, a third set of data, a fourth set of data, and a combination thereof; (b) computing a travel score for a travel direction of an intersection by weighing each of the first set of data, the second set of data, the third set of data, and the fourth set of data with respect to one another; (c) determining whether the travel score is a highest travel score of the intersection; (d) determining whether a restriction is placed on the travel direction; (e) determining whether a special vehicle is present; and (f) enabling traffic flow in the travel direction if: (i) the determining in (c) determines that the travel score is the highest travel score of the intersection, the determining in (d) determines that no restriction is placed on the travel direction, and the determining in (e) determines that no special vehicle is present, or (ii) the determining in (c) determines that the travel score is not the highest travel score of the intersection, a predetermined time has elapsed, the determining in (d) determines that no restriction is placed on the travel direction, and the determining in (e) determines that no special vehicle is present.

In yet another aspect, one or more embodiments disclosed herein relate to a non-transitory computer readable medium comprising computer readable program code, which when executed by a computer processor, enables the computer processor to: (a) obtain at least one of a first set of data, a second set of data, a third set of data, a fourth set of data, and a combination thereof; (b) compute a travel score for a travel direction of an intersection by weighing each of the first set of data, the second set of data, the third set of data, and the fourth set of data with respect to one another; (c) determine whether the travel score is a highest travel score of the intersection; (d) determine whether a restriction is placed on the travel direction; (e) determine whether a special vehicle is present; (f) enable traffic flow in the travel direction if: (i) the determine in (c) determines that the travel score is the highest travel score of the intersection, the determine in (d) determines that no restriction is placed on the travel direction, and the determine in (e) determines that no special vehicle is present, or (ii) the determine in (c) determines that the travel score is not the highest travel score of the intersection, a predetermined time has elapsed, the determine in (d) determines that no restriction is placed on the travel direction, and the determine in (e) determines that no special vehicle is present; (g) rank all travel scores of the intersection and create a traffic flow cycle for (f) to enable traffic flows in different travel directions based on rankings of the travel scores.

Other aspects and advantages of the disclosure will be apparent from the following description and the appended claims.

DETAILED DESCRIPTION

Figure 1A:
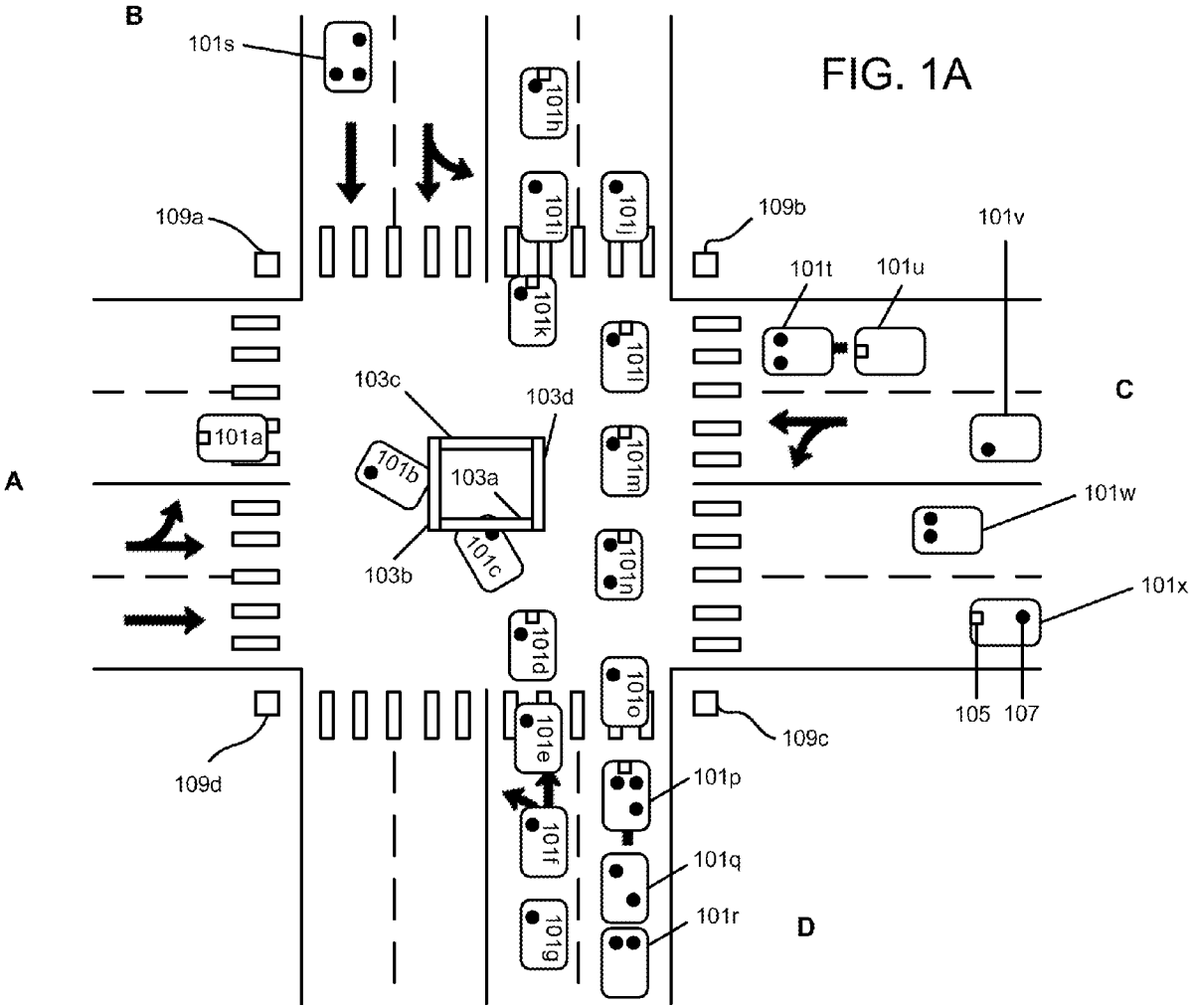
FIG. 1A shows a traffic flow control system according to one or more embodiments of the disclosure applied to an intersection.

Specific embodiments will now be described in detail with reference to the accompanying figures. Like elements in the various figures are denoted by like reference numerals for consistency. Like elements may not be labelled in all figures for the sake of simplicity.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create a particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure relate to a traffic flow control system. In general, embodiments of the disclosure relate to a traffic flow control method.

FIG. 1A shows a traffic flow control system according to one or more embodiments of the disclosure applied to an intersection. FIG. 1A shows vehicles (101*a*-101*x*), each of which may comprise a first type computing device (107) and a second type computing device (105). FIG. 1A also shows display devices (103*a*-103*d*) and user interactive devices (109*a*-109*d*). Each of these components is described below.

In one or more embodiments of the disclosure, the first type computing device (107) may be a smart phone, a global positioning system, a laptop, a tablet computer, an electronic reader (e-reader), a cable box, a kiosk, a server, a mainframe, a desktop personal computer, a personal digital assistant (PDA), or any other type of hardware device.

In one or more embodiments of the disclosure, the second type computing device (105) may be a smart phone, a global positioning system, a laptop, a tablet computer, an electronic reader (e-reader), a cable box, a kiosk, a server, a mainframe, a desktop personal computer, a personal digital assistant (PDA), or any other type of hardware device.

In one or more embodiments of the disclosure, the first type computing device (107) is different from the second type computing device (105).

In one or more embodiments of the disclosure, the display devices (103*a*-103*d*) may be traffic lights for pedestrians, bicycles, cars, trains, cargos, ferries, planes, or any other mode of transportation requiring signaling.

In one or more embodiments of the disclosure, the user interactive devices (109*a*-109*d*) may be panels each having at least a button (not shown) for pedestrians to press to express interest in crossing at the intersection and a plurality of display icons. In one or more embodiments of the disclosure, the user interactive devices may be used to signal pedestrians, cyclers, etc.

One of ordinary skill in the art would appreciate that FIG. 1A is a mere example and that the number, shape, size, orientation, etc., of vehicle, display device, user interactive device, first type computing device, second type computing device, etc., of the system can vary from one embodiment to another without departing from the spirit of the disclosure.

FIG. 1A shows a four-way (forks A-D) intersection having 16 travel directions (4 forks*(go straight+turn right+turn left+U-turn)). However, in one or more embodiments of the disclosure, only 8 of the 16 travel directions (4 forks*(go straight+turn left)) require regulation by the display devices. One of ordinary skill in the art would appreciate that "turn right" may be possible when the display device signals "go straight." One of ordinary skill in the art would appreciate that "turn right" may be possible when the display device does not signal "go straight." One of ordinary skill in the art would appreciate that "U-turn" may be possible when the display device signals "turn left." In one or more embodiments, pedestrian crossings may constitute additional travel directions.

FIG. 1A shows that the "go straight" and the "turn left" signals are available to vehicles (101*e*-101*g*), for example. That is, travel directions DA and DB (travel direction from D to A, from D to B, etc.) are flowing. All other vehicles that are not signaled to "go straight" or "turn left" are restricted from travel, but may, on the right occasion, "turn right." For example, the vehicle (101*t*) does not have the right of way, but may "turn right" from fork C to fork B on the right occasion. That is, the vehicle (1010 may travel in the CB flow on the right occasion.

Figure 3:
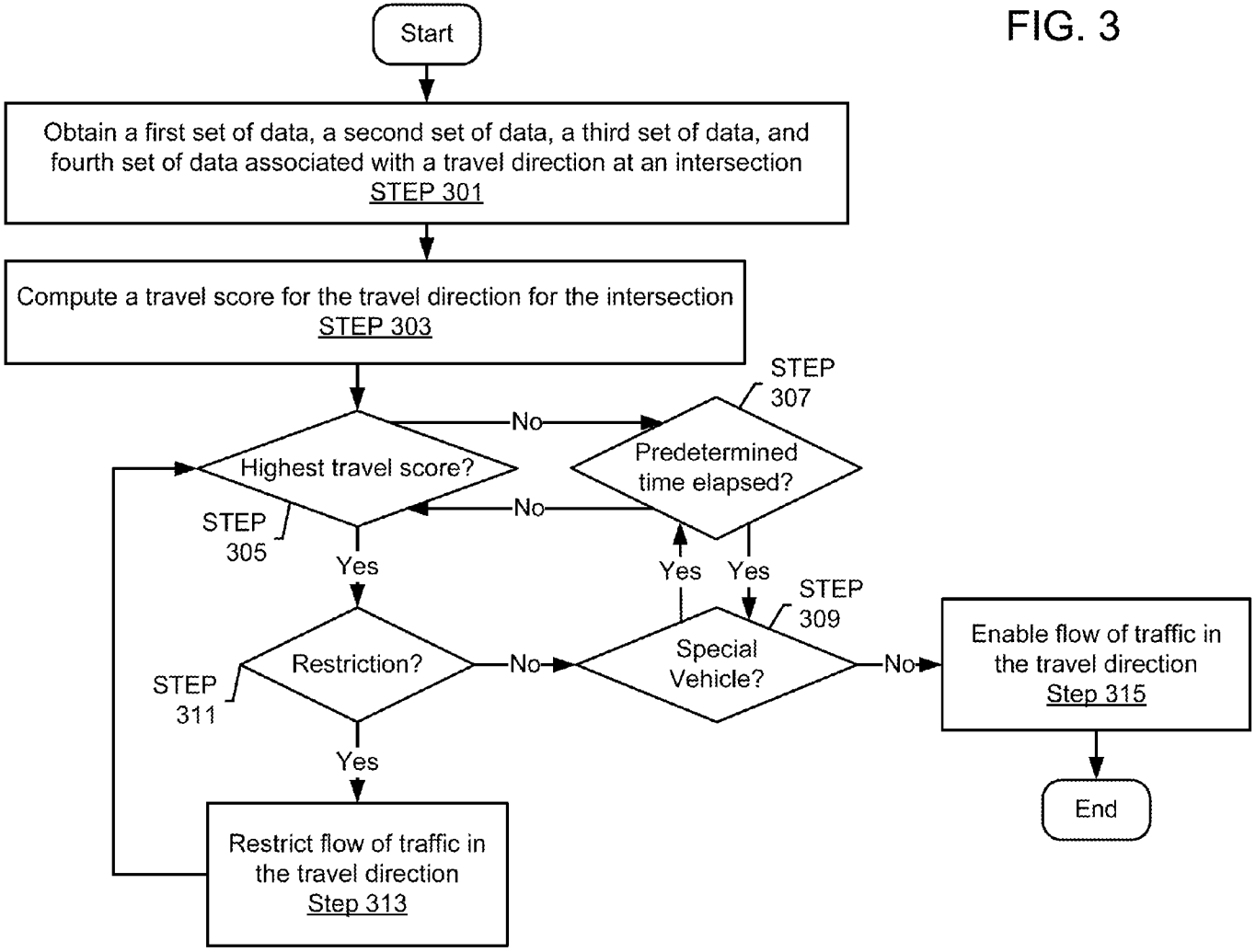
FIG. 3 shows a traffic flow control method according to one or more embodiments of the disclosure.

More details regarding the traffic flow control method as applied to, for example, the traffic flow control system shown in FIG. 1A is discussed in reference to FIG. 3.

Figure 1B:
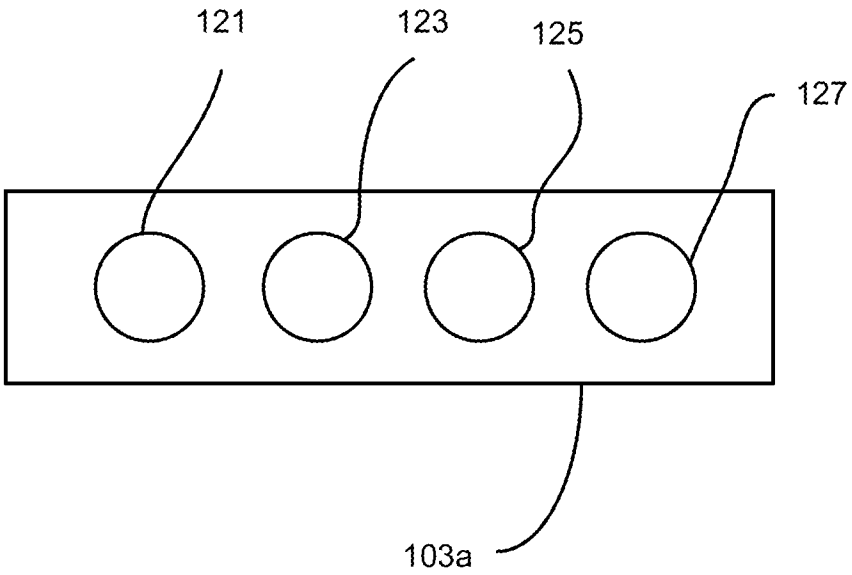
FIG. 1B shows a display device of a traffic flow control system according to one or more embodiments of the disclosure.

FIG. 1B shows a display device of a traffic flow control system according to one or more embodiments of the disclosure. FIG. 1B shows a display device that regulates traffic at an intersection. FIG. 1B shows the display device (103*a*) having a left turn signal (121), a green light (123) that signals "go straight," an amber light (125) that signals that the display device (103*a*) is about to place restriction on the travel direction, and a red light (127) that restricts travel in the travel direction.

Figure 1C:
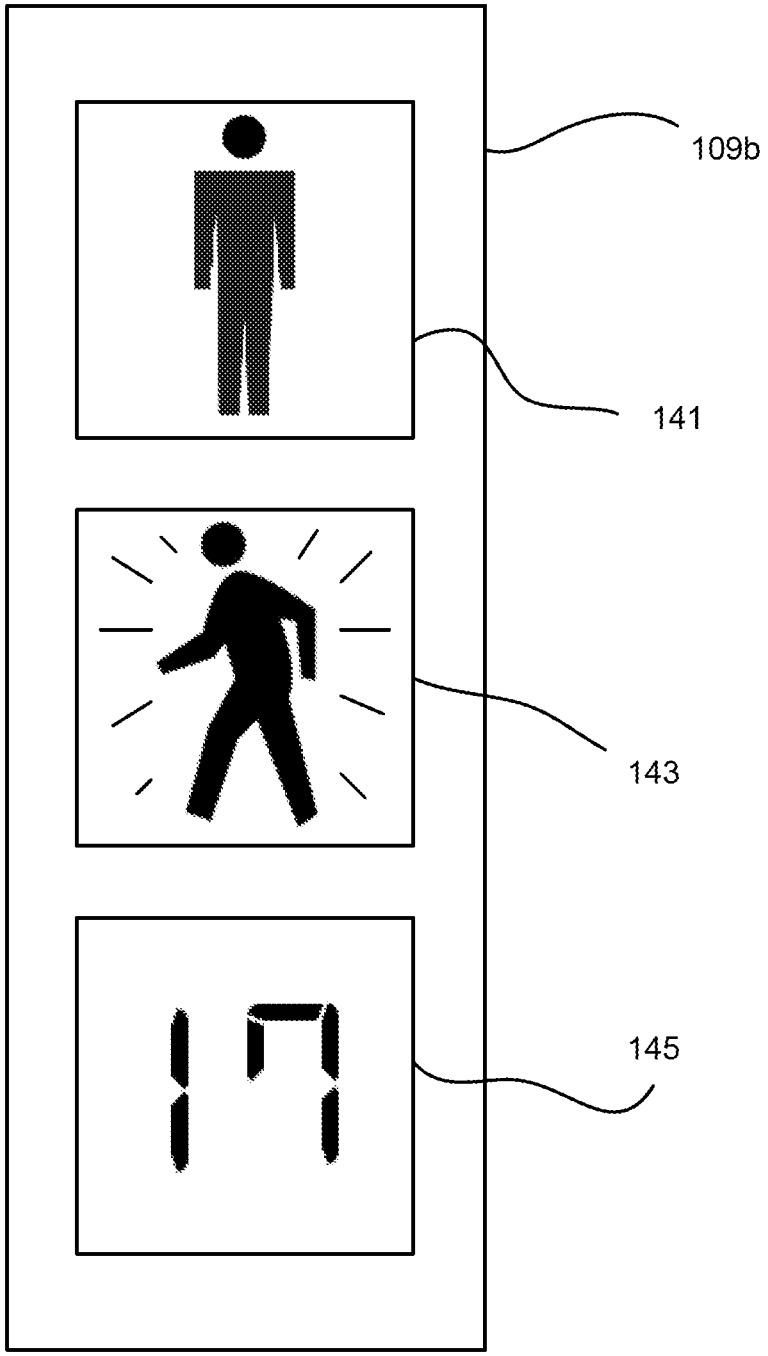
FIG. 1C shows a user interactive device of a traffic flow control system according to one or more embodiments of the disclosure.

FIG. 1C shows an user interactive device of a traffic flow control system according to one or more embodiments of the disclosure. The user interactive device (109*b*) may comprise display icons—a stop sign (141), a go sign (143), a countdown timer (145) that indicates how long until the stop sign (141) changes to the go sign (143), and vice versa. In FIG. 1C, an example of the go sign (143) being illuminated is shown. Additionally, a countdown timer (145) counts down until when the go sign (143) is to switch to the stop sign (141). FIG. 1C shows that in 17 seconds, the go sign (143) will cease to illuminate and the stop sign (141) will begin to illuminate. In one or more embodiments, the user interactive device (109*b*) may comprise a panel having at least one button for pedestrians to press, thereby expressing interest in crossing at the intersection. A plurality of buttons may be provided to differentiate between those pedestrians wishing to cross from the user interactive device (109*c*) to the user interactive device (109*b*) and those pedestrians wishing to cross from the user interactive device (109*c*) and the user interactive device (109*a*). In one or more embodiments, depending on demand (which could be obtained by using the third set of data (see below), for example), the traffic flow control system may enable pedestrian crossings from the user interactive device (109*c*) to the user interactive device (109*a*), and vice versa and enable pedestrian crossings from the user interactive device (109*b*) to the user interactive device (109*d*), and vice versa.

Figure 2A:
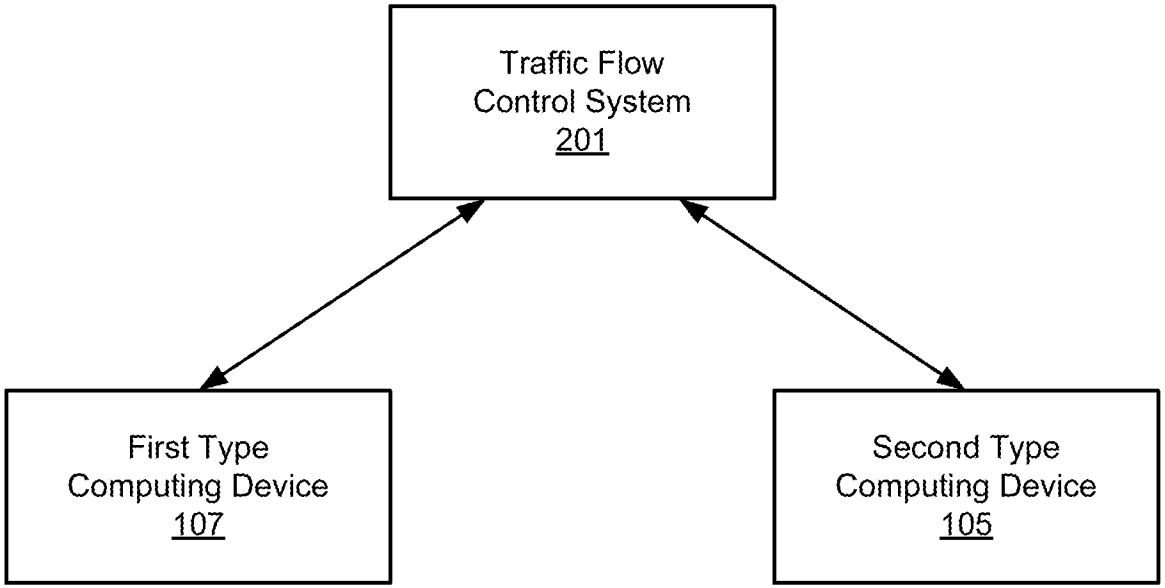
FIG. 2A shows a traffic flow control system according to one or more embodiments of the disclosure.

FIG. 2A shows a traffic flow control system according to one or more embodiments of the disclosure. The traffic flow control system (201) may comprise display devices (103*a*-*d*), an image acquisition module (not shown) configured to be mounted on or in the vicinity of the display devices (103*a*-*d*), user interactive devices (109*a*-*d*), and a server. The various components may communicate to one another either wired- or wirelessly.

In one or more embodiments of the disclosure, the traffic flow control system (201) is configured to receive a first set of data from a first type computing device (107) and a second set of data from a second type computing device (105).

In one or more embodiments of the disclosure, the first set of data may comprise a count of the first type computing device (107) at, or near, fork A, for example. In one or more embodiments of the disclosure, the first set of data may comprise a speed at which the first type computing device (107) is approaching fork A, for example.

In one or more embodiments of the disclosure, the second set of data may comprise a count of the second type computing device (105) at, or near, fork A, for example. In one or more embodiments of the disclosure, the second set of data may comprise a speed at which the second type computing device (107) is approaching fork A, for example. In one or more embodiments of the disclosure, the second set of data may comprise a destination and/or route information of the second type computing device (107).

Returning to FIG. 1A for purposes of illustration only, various methods may help the traffic flow control system (201) determine that no first type computing device (107) and no second type computing device (105) is at fork A. Likewise, various methods may help the traffic flow control system (201) determine that there are 3 first type computing devices (107) and 1 second type computing device (105) waiting for right of way at fork C, etc., for example. Of course, there may be more first type computing devices (107) being carried by pedestrians in proximity to fork C. However, as discussed above, the third set of data may include a count of pedestrians located in proximity to fork C, for example, and adjust a travel score (to be explained in reference to FIG. 3) accordingly to differentiate between those computing devices that are within vehicles and those computing devices that belong to pedestrians.

Some of the various methods may be: global positioning system, assisted global positioning system, synthetic global positioning system, cellular identification, wireless fidelity, inertial sensors, barometers, ultrasonic, Bluetooth beacons, terrestrial transmitters, etc.

Figure 2B:
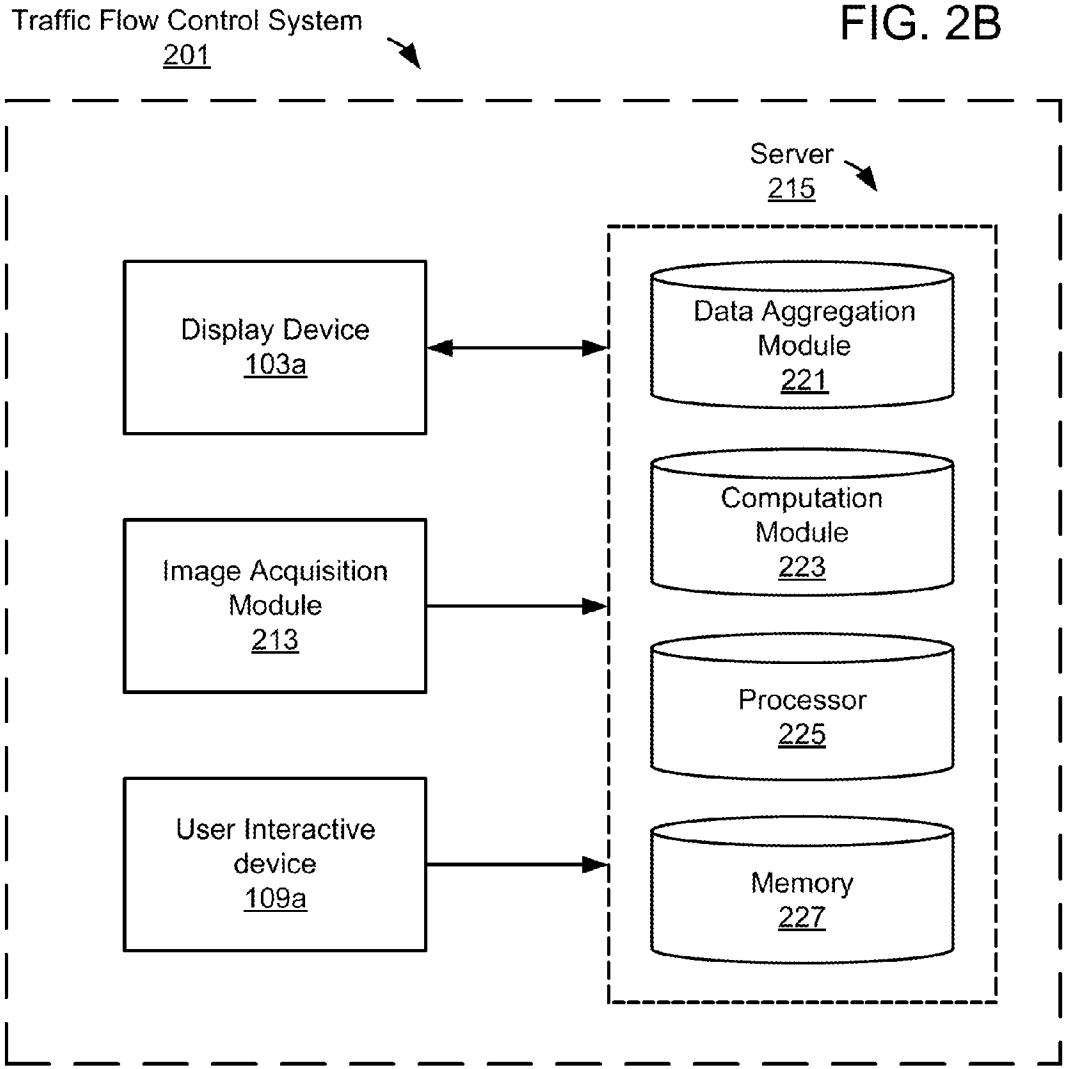
FIG. 2B shows a traffic flow control system according to one or more embodiments of the disclosure.

FIG. 2B shows a traffic flow control system according to one or more embodiments of the disclosure. The traffic flow control system (201) may comprise a display device (103*a*), an image acquisition module (213), an user interactive device (109*a*), sensor modules (not shown), and a server (215). The server (215) may comprise a data aggregation module (221), a computation module (223), a processor (225), and a memory (227). Each of these components is explained below; however, components that have already been described will be omitted for the sake of brevity.

As discussed, the image acquisition module (213) may be any image acquiring apparatus. In one or more embodiments, the image acquisition module (213) may be a camera, a heat-map generator, etc. The image acquisition module (213) may be configured to acquire a third set of data. In one or more embodiments, the third set of data may comprise a count of vehicles located at fork A. The count may be obtained, not only by the image acquisition module (213), but also by sensor modules (not shown) buried beneath a ground associated with fork A. Further, one of ordinary skill in the art would appreciate that sensor modules need not be located at or near the fork for which they are to be deployed. For example, they may be located 100 meters, 200 meters, 500 meters, etc., away from the fork A and be configured to measure traffic flow for vehicles going from fork A to another fork of the intersection. The image acquisition module (213), the sensor module (not shown), the display device (103*a*), the user interactive device (109*a*), etc., may communicate wired- or wirelessly with the server (215). For example, the image acquisition module (213) may forward the third set of data to the server (215). In one or more embodiments, the third set of data may comprise images, taken from close to a center of the intersection, of a fork, e.g., fork A. The third set of data may comprise a count of vehicles at fork A as well as a count of pedestrians located close to the user interactive devices (109*a*, 109*d*). In one or more embodiments, the third set of data may comprise a count of vehicles located at fork A. The count may be obtained by sensor modules buried beneath a ground associated with fork A.

In one or more embodiments, the user interactive devices (109*a*-109*d*) may be panels each having at least a button (not shown) for pedestrians to press to express interest in crossing at the intersection and a plurality of display icons. As discussed, the user interactive devices (109*a*-109*d*) may communicate wired- or wirelessly with the server (215). In one or more embodiments of the disclosure, the user interactive devices (109*a*-109*d*) may be used to signal pedestrians, cyclers, etc. Pedestrians may press the button of the user interactive devices (109*a*-109*d*) to indicate their desire to cross, thereby sending a fourth set of data to the traffic flow control system (201). The fourth set of data may comprise a time in which the pedestrian pressed the button. Upon pressing the button, a timer (which may or may not be shown to the user) of the user interactive device (109*a*) may count down. In one or more embodiments of the disclosure, the fourth set of data may comprise binary entries (the button is either pressed or not pressed).

The data aggregation module (221) may be a part of the server (215); the server may or may not be located separately from the display device (103*a*), the image acquisition module (213), and/or the user interactive device (109*a*). Likewise, the display device (103*a*) may or may not be located separately from the server (215), the image acquisition module (213), and/or the user interactive device (109*a*). The same may be true for the image acquisition module (213), the user interactive device (109*a*), etc.

In one or more embodiments, the data aggregation module (221) may obtain the first set of data, the second set of data, the third set of data, and the fourth set of data. In one or more embodiments, the data aggregation module (221) may standardize the various sets of data so that the entries may be further processed by the computation module (225) to arrive at a travel score for a particular travel direction.

In one or more embodiments, the computation module (223) may receive the various sets of data from the data aggregation module (221). In one or more embodiments, the computation module (223) may compute a travel score of a fork by adding the number of vehicles, the number of first type computing devices, the number of second type computing devices, etc. In one or more embodiments, in the event that two forks have equal numbers of first type computing devices and equal numbers of second type computing devices, the fork with more vehicles may be assigned a greater score. In one or more embodiments, the intersection may evaluate the third set of data and the fourth set of data and place more weight on the combination of the two and give higher priority to pedestrians wishing to cross. That is, the third set of data is able to image the number of pedestrians close to the user interactive devices and the fourth set of data is able to determine whether there are pedestrians wishing to cross at the intersection. Further, one of ordinary skill in the art would appreciate that each count (of the vehicle, of the first type computing device, of the second type computing device, etc.) may be weighed differently. For example, in one intersection, the number of vehicle may be weighed 90% in the travel score, whereas the summation of the first data set (the number of first type computing devices), the second data set (the number of second type computing devices), and the fourth data set (whether the button of the user interactive device has been pressed) weigh a meager 10%.

In one or more embodiments of the disclosure, the processor (225) may be an integrated circuit for processing instructions. For example, the processor (225) may be one or more cores, or micro-cores of a processor.

In one or more embodiments of the disclosure, the memory (227) may be, for example, random access memory (RAM), cache memory, flash memory, etc.

Turning to the flowcharts, while the various steps in the flowcharts are presented and described sequentially, one of ordinary skill will appreciate that some or all of the steps may be executed in different orders, may be combined or omitted, and some or all of the steps may be executed in parallel.

FIG. 3 shows a traffic flow control method according to one or more embodiments of the disclosure. The method shown in FIG. 3 may be implemented by the traffic flow control system (201).

In Step 301, a first set of data may be obtained from, e.g., a first type computing device, a second set of data may be obtained from, e.g., a second type computing device, a third set of data may be obtained from, e.g., an image acquisition module, a fourth set of data may be obtained from, e.g., an user interactive device. In one or more embodiments of the disclosure, the first set of data may be a count of the first type computing devices at fork A. In one or more embodiments of the disclosure, the second set of data may be a count of the second type computing devices at fork A. In one or more embodiments of the disclosure, the third set of data may be a heat map of fork A. In one or more embodiments of the disclosure, the third set of data may be a count of the vehicles of fork A. In one or more embodiments of the disclosure, the fourth set of data may be a binary input, indicating whether the button has been depressed or the button has not been depressed.

In Step 303, a travel score for fork A (either an aggregate of vehicles going straight or turning left or just those going straight or just those turning left) may be computed. The score may be weighted or may just be a simple count and rank protocol.

In Step 305, the traffic flow control system may determine, for example, whether the travel score for those turning left from fork A (AB) is the highest out of all travel scores for the intersection. Non-competing travel scores may also be summed as a unit for consideration by the traffic flow control system. For instance, a travel score for those at fork D going to fork B (DB) may be added to a travel score for those at fork B going to fork D (BD). The aggregate score may be compared to the summation of a travel score for those at fork D going to fork A (DA) and a travel score for those at fork B going to fork C (BC). If the travel score of DB (denoting travelling from D to B) plus BD is greater than DA plus BC, then the traffic flow control system may give higher priority to the DB and BD flow. In one or more embodiments, the travel score BD and DB may be summed with the travel score assigned to those pedestrians traveling from the user interactive device (109*c*) to the user interactive device (109*b*), and vice versa, as well as the travel score assigned to those pedestrians traveling from the user interactive device (109*a*) to the user interactive device (109*d*), and vice versa. The 6 travel scores are considered non-competing and may be added and compared to other travel scores. If the travel score is the highest travel score for the intersection, the flowchart may proceed to Step 311; if the travel score is not the highest score for the intersection, the flowchart may proceed to Step 307.

In Step 311, the traffic flow control system determines whether a restriction has been placed on the direction of travel. For example, if the traffic flow control system is enabling BD and DB flow, the DA flow is not permitted to flow even if it is the highest score. Thus, if it is determined that the DA flow is restricted by the BD and DB flow, the flowchart may continue to Step 313. If it is determined that the DA flow is not restricted, then the flowchart may continue to Step 309.

In Step 313, the DA flow is restricted and the flowchart may continue to Step 305.

In Step. 307, the traffic flow control system determines whether a predetermined time has elapsed for the DA flow. If the predetermined time has not yet elapsed for the DA flow, the flowchart may return to Step 305; if the predetermined time has elapsed, the flowchart may continue to Step 309.

In Step 309, the traffic flow control system may determine whether a special vehicle is present by using the image acquisition module (213). In one or more embodiments, the special vehicle may be configured to communicate directly with the traffic flow control system governing the intersection. In one or more embodiments, the special vehicle may be an ambulance, a firetruck, or a police car. If the traffic flow control system determines that there is a special vehicle, then the flowchart may return to Step 307. If the traffic flow control system determines that there is no special vehicle, then the flowchart may proceed to Step 315.

In Step 315, the traffic flow control system may enable the DA flow.

While the disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered as examples because many other architectures can be implemented to achieve the same functionality.

The process parameters and sequence of steps described and/or illustrated herein are given by way of example only. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While the disclosure has been described with respect to a limited number of embodiments, those skilled in the art, having benefit of this disclosure, will appreciate that other embodiments can be devised which do not depart from the scope of the disclosure as disclosed herein.

For example, one of ordinary skill in the art would appreciate that the traffic flow control system and method thereof may be amended to comply with the various regional traffic laws around the world.

For example, one of ordinary skill in the art would appreciate that the traffic flow control method described in FIG. 3 may be configured with other traffic protocols. That is, the intersection may utilize timers (i.e., 30 seconds for the first travel direction, then 30 seconds for the second travel direction, etc.) when the travel score is below a predetermined threshold and only switch to the method of FIG. 3 when the travel score is at or below the predetermined threshold.

For example, in one or more embodiments of the disclosure, the memory may be configured to store travel patterns of various directions and automatically enable the traffic flow control system to weigh and re-weigh the various sets of data according to time of day and historical data.

For example, in one or more embodiments, although FIG. 1A shows a DA flow on the D fork side having at least 11 first type computing device, the traffic flow control system may actually pick up 21 first type computing devices—11 within vehicles and 5 pedestrians in the proximity of the user interactive device (109*c*) and 5 pedestrians in the proximity of the user interactive device (109*d*). The image acquisition module may image the 10 pedestrians and subtract the pedestrians from the 21 first type computing devices initially picked up by the flow control system to arrive at an accurate count for the vehicles travelling in the DA flow and having the first type computing devices. This number may then be considered in view of the total number of vehicles, the number of second type computing devices, etc., to arrive at a travel score.

For example, in one or more embodiments, the number of vehicles is ranked higher than the number of first type computing devices; the number of first type computing devices is ranked higher than the number of second type computing devices; and, the number of second type computing devices is ranked higher than when the user interactive device indicates that a button thereof has been depressed. One of ordinary skill in the art would appreciate that any of the first set, second set, third set, and fourth set of data may be weighed anywhere between 0% and 100% with respect to one another.

For example, if two travel flows compete with one another, none of the two constitutes the highest travel score of the intersection, and both have waited for their predetermined time to elapse, the travel flow having the higher score may flow first before the travel flow with the lower score flows.

For example, when all non-highest travel directions have waited for their predetermined time to elapse, the travel flow with the highest score will wait until each of the non-highest travel directions flows once in accordance to their relative ranks—the higher the travel score, the higher the priority to flow.

For example, in one or more embodiments, all the travel scores of an intersection may be added to compute an intersection score. Intersection scores for a plurality of intersections may be computed to optimize travel flow in a section of a city. In one or more embodiments, geo-fences may be created (using intersections as centers, for example) to determine traffic flow in an area encompassing multiple intersections. Using global positioning systems data obtained from the second set of data and vehicle counts using the third set of data, the traffic flow control system and method thereof can be expanded to cover not only a single intersection, but an area having a plurality of intersections. The same thing can be said when expanding coverage from these small regions to a whole metropolis, thereby optimizing travel time and reducing traffic congestion for the whole metropolis.

For example, in one or more embodiments, travel scores, intersection scores, etc., may be forwarded to global positioning systems, map applications, etc., to provide and/or optimize route conditions, travel time estimations, etc.

For example, although FIG. 1A shows a traffic flow control system being applied to an intersection having four forks, the disclosure is not limited thereto. One of ordinary skill in the art would appreciate that the traffic flow control system and method thereof may be applied to any situation in which prioritization of traffic flow is required. For example, the traffic flow control system and method thereof may be applied to airports, aircraft carriers, harbors, race tracks, intersections with one or more forks, railroads, hyperloop, etc.

For example, in one or more embodiments, the first set of data and/or the second set of data may be directly obtained from transmission systems, global positioning systems, etc., built in the vehicles themselves. For example, the vehicle may be a self-driving car that communicates with the traffic flow control system.

Furthermore, one of ordinary skill in the art would appreciate that certain "components," "units," "parts," "elements," "modules," or "portions" of one or more embodiments of the present disclosure may be implemented by a circuit, processor, etc., using any known methods. Accordingly, the scope of the disclosure should be limited only by the attached claims.

What is claimed is:

1. A traffic flow control system comprising:

a display device;

an image acquisition module;

a user interactive device; and a server having a processor, the processor is configured to:

obtain, by a data aggregation module, at least one of a first set of data from a first type computing device, a second set of data from a second type computing device, a third set of data from the image acquisition module, a fourth set of data from the user interactive device, and a combination thereof, compute, by a computation module, a travel score for a travel direction of an intersection by weighing each of the first set of data, the second set of data, the third set of data, and the fourth set of data with respect to one another, determine whether the travel score is a highest travel score of the intersection, and if the travel score is the highest travel score of the intersection, enable traffic flow in the travel direction using the display device, wherein:

a data entry of the first set of data comprises a count of mobile devices for the direction of travel, and a data entry of the third set of data comprises a count of vehicles for the travel direction and a count of pedestrians in a detection zone of the image acquisition module, and wherein the count of the pedestrians in the detection zone is compared to the count of mobile devices to adjust the weighing.

2. The traffic flow control system according to claim 1, wherein the processor is configured to determine whether a restriction is placed on the travel direction before the enable and after the determine determines that the travel score is the highest travel score of the intersection.

3. The traffic flow control system according to claim 2, wherein:

if no restriction is placed on the travel direction, the processor is configured to determine whether a special vehicle is present, and if the restriction is placed on the travel direction, the processor is configured to restrict the traffic flow in the travel direction.

4. The traffic flow control system according to claim 3, wherein, if no special vehicle is present, the processor is configured to enable the traffic flow in the travel direction using the display device.

5. The traffic flow control system according to claim 1, wherein, if the travel score is not the highest, the processor is configured to determine whether a predetermined time has elapsed for the travel direction.

6. The traffic flow control system according to claim 5, wherein, if the predetermined time has elapsed, the processor is configured to determine whether a restriction is placed on the travel direction.

7. The traffic flow control system according to claim 6, wherein:

if no restriction is placed on the travel direction, the processor is configured to determine whether a special vehicle is present, and if the restriction is placed on the travel direction, the processor is configured to restrict the traffic flow in the travel direction.

8. The traffic flow control system according to claim 7, wherein, if no special vehicle is present, the processor is configured to enable the traffic flow in the travel direction using the display device.

9. The traffic flow control system according to claim 1, wherein:

the first type computing device is a smart phone, the second type computing device is a global positioning system, and the image acquisition module is a video camera.

10. The traffic flow control system according to claim 1, wherein the third set of data is obtained from a sensor module associated with the travel direction.

11. The traffic flow control system according to claim 10, wherein the sensor module is buried beneath a ground associated with the travel direction.

12. The traffic flow control system according to claim 3, wherein the special vehicle is an ambulance, a fire truck, or a police car.

13. The traffic flow control system according to claim 5, wherein the processor is configured to rank all travel scores of the intersection and create a traffic flow cycle to enable traffic flows in different directions based on rankings of the travel scores.

14. A traffic flow control method comprising:

(a) obtaining at least one of a first set of data, a second set of data, a third set of data, a fourth set of data, and a combination thereof;

(b) computing a travel score for a travel direction of an intersection by weighing each of the first set of data, the second set of data, the third set of data, and the fourth set of data with respect to one another;

(c) determining whether the travel score is a highest travel score of the intersection;

(d) determining whether a restriction is placed on the travel direction; and (f) enabling traffic flow in the travel direction if:

(i) the determining in (c) determines that the travel score is the highest travel score of the intersection and the determining in (d) determines that no restriction is placed on the travel direction, or (ii) the determining in (c) determines that the travel score is not the highest travel score of the intersection, a predetermined time has elapsed, and the determining in (d) determines that no restriction is placed on the travel direction, wherein:

a data entry of the first set of data comprises a count of mobile devices for the direction of travel, and a data entry of the third set of data comprises a count of vehicles for the travel direction and a count of pedestrians in a detection zone of an image acquisition module, and wherein the count of the pedestrians in the detection zone of the image acquisition module is compared to the count of mobile devices to adjust the weighing in (b).

15. The traffic flow control method according to claim 14 further comprising ranking all travel scores of the intersection and creating a traffic flow cycle for (f) to enable traffic flows in different travel directions based on rankings of the travel scores.

16. The traffic flow control method according to claim 14, wherein the special vehicle is an ambulance, a fire truck, or a police car.

17. A non-transitory computer readable medium comprising computer readable program code, which when executed by a computer processor, enables the computer processor to:

(a) obtain at least one of a first set of data, a second set of data, a third set of data, a fourth set of data, and a combination thereof;

(b) compute a travel score for a travel direction of an intersection by weighing each of the first set of data, the second set of data, the third set of data, and the fourth set of data with respect to one another;

(c) determine whether the travel score is a highest travel score of the intersection;

(d) determine whether a restriction is placed on the travel direction;

(f) enable traffic flow in the travel direction if:

(i) the determine in (c) determines that the travel score is the highest travel score of the intersection and the determine in (d) determines that no restriction is placed on the travel direction, or (ii) the determine in (c) determines that the travel score is not the highest travel score of the intersection, a predetermined time has elapsed, and the determine in (d) determines that no restriction is placed on the travel direction; and (g) rank all travel scores of the intersection and create a traffic flow cycle for (f) to enable traffic flows in different travel directions based on rankings of the travel scores, wherein:

a data entry of the first set of data comprises a count of smart phones for the direction of travel, a data entry of the second set of data comprises a count of global positioning systems for the travel direction, a data entry of the third set of data comprises a count of vehicles for the travel direction and a count of pedestrians in a detection zone of an image acquisition module, a data entry of the fourth set of data comprises a binary input, and the count of the pedestrians in the detection zone of the image acquisition module is compared to the count of smart phones to adjust the weighing in (b).

18. The traffic flow control method according to claim 14 further comprising, after the determining in (d) and before the enabling in (f), (e) determining whether a special vehicle is present.

19. The traffic flow control system according to claim 1, wherein:

a data entry of the second set of data comprises a count of global positioning systems for the travel direction, and a data entry of the fourth set of data comprises a binary input.

20. The traffic flow control method according to claim 14, wherein:

a data entry of the second set of data comprises a count of global positioning systems for the travel direction, and a data entry of the fourth set of data comprises a binary input.

* * * * *